US009572437B1

(12) United States Patent
Ou

(10) Patent No.: US 9,572,437 B1
(45) Date of Patent: Feb. 21, 2017

(54) TOOL HOLDER

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 14/947,667

(22) Filed: Nov. 20, 2015

(51) Int. Cl.
*A47F 7/00* (2006.01)
*A47F 7/024* (2006.01)

(52) U.S. Cl.
CPC ..... *A47F 7/024* (2013.01); *A47F 7/0035* (2013.01)

(58) Field of Classification Search
CPC ..... B25H 3/04; B25H 3/003; A47F 7/0035
See application file for complete search history.

(56) References Cited

U.S. PATENT DOCUMENTS 5,967,340 A * 10/1999 Kao ..... B25H 3/04 206/493
6,092,656 A * 7/2000 Ernst ..... B25H 3/06 206/378
6,415,933 B1 * 7/2002 Kao ..... B25H 3/003 206/378
6,508,360 B1 * 1/2003 Chen ..... B25H 3/003 206/349
6,669,032 B2 * 12/2003 Kao ..... E05B 73/00 206/378
8,307,980 B1 * 11/2012 Kao ..... B25H 3/04 206/372
8,317,021 B2 * 11/2012 Christopher ..... B25H 3/022 206/234
8,376,153 B1 * 2/2013 Lee ..... B25H 3/003 206/377
8,381,905 B1 * 2/2013 Kao ..... B25H 3/003 206/1.5
8,550,244 B1 * 10/2013 Ou ..... B65D 71/50 206/378
8,800,767 B2 * 8/2014 Wang ..... B25H 3/04 206/372
8,875,884 B1 * 11/2014 Lee ..... B25H 3/04 206/1.5
9,073,202 B2 * 7/2015 Wang ..... B25H 3/00
2003/0024837 A1 * 2/2003 Chen ..... B25H 3/003 206/378
2003/0070999 A1 * 4/2003 Kao ..... B25H 3/003 211/70.6

(Continued)

FOREIGN PATENT DOCUMENTS

TW M454912 U 6/2013

*Primary Examiner* — Leslie A Nicholson, III
*Assistant Examiner* — Kimberley S Wright
(74) *Attorney, Agent, or Firm* — Muncy, Geissler, Olds & Lowe, P.C.

(57) ABSTRACT

A tool holder includes a main body, a positioning member and at least one rod. The main body includes a hanging portion and an assembling portion protrudingly formed with at least one first engaging block. The positioning member is assembled to the main body and extends toward the assembling portion to form at least one second engaging block. The first and second engaging blocks are for being engaged with two ends of one socket respectively, and two opposite ends of the positioning member are respectively fixed to the main body via a first fixing member. The rod has a first end and a second end, the first end is disposed on one said first engaging block, each rod is disposed through one socket, and the second end and one said second engaging block are fixed to each other via a second fixing member.

6 Claims, 4 Drawing Sheets

(56) References Cited

U.S. PATENT DOCUMENTS

| | | | | |
|---|---|---|---|---|
| 2003/0102275 | A1* | 6/2003 | Kao | B25H 3/003 211/70.6 |
| 2003/0213760 | A1* | 11/2003 | Lee | B25H 3/003 211/70.6 |
| 2010/0170817 | A1* | 7/2010 | Wu | B25H 3/04 206/378 |
| 2012/0118836 | A1* | 5/2012 | Wu | B25H 3/003 211/4 |
| 2013/0098851 | A1* | 4/2013 | Hsiao | E05B 73/0023 211/4 |
| 2013/0126449 | A1* | 5/2013 | Sh | B25H 3/04 211/4 |
| 2013/0240394 | A1* | 9/2013 | Wang | B25H 3/04 206/372 |
| 2014/0238880 | A1* | 8/2014 | Wang | B25H 3/04 206/349 |
| 2014/0291263 | A1* | 10/2014 | Chen | B25H 3/003 211/70.6 |

* cited by examiner

TOOL HOLDER

BACKGROUND OF THE INVENTION

Field of the Invention

The present invention relates to a tool holder, and more particularly to an anti-theft tool holder.

Description of the Prior Art

Usually, when a socket is in storage or put on shelves, the socket is connected with a holder, and then, the holder is placed on the wall or the display board. A conventional holder has a main body, a side of the main body is protrudingly formed with an engaging block, the engaging block is engaged with one end of the socket, the other end of the socket abuts against a lateral wall of the other side of the main body so as to connect the socket and the holder together. The above-mentioned holder is disclosed in TWM454912.

The conventional holder can be connected with the socket and can be hung on the wall; however, when a lateral outward force is applied to the lateral wall of the main body, the lateral wall is bent and deformed outwardly. Therefore, the socket cannot abut against the lateral wall of the main body, and the socket can be disengaged with the engaging block. Hence, the conventional holder does not have an anti-theft function, and the holder may be easily stolen when being put on shelves.

The present invention has arisen to mitigate and/or obviate the afore-described disadvantages.

SUMMARY OF THE INVENTION

The major object of the present invention is to provide a tool holder which can prevent a lateral wall of the tool holder from being bent and deformed outwardly and prevent a socket from being disengaged with the tool holder. Therefore, the tool holder is anti-theft.

To achieve the above and other objects, a tool holder is provided for at least one socket to be assembled thereto. The tool holder includes a main body, a positioning member and at least one rod. The main body includes a hanging portion and an assembling portion, and the assembling portion is protrudingly formed with at least one first engaging block. The positioning member is assembled to the main body and extends toward the assembling portion to form at least one second engaging block opposite to the at least one first engaging block, each said first engaging block and each said second engaging block are engaged with two ends of one said socket respectively, and two opposite ends of the positioning member are respectively fixed to the main body via a first fixing member. The at least one rod has a first end and a second end opposite to the first end, the first end is disposed on one said first engaging block, each said rod is for being disposed through one said socket, and the second end of the rod and one said second engaging block are fixed to each other via a second fixing member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
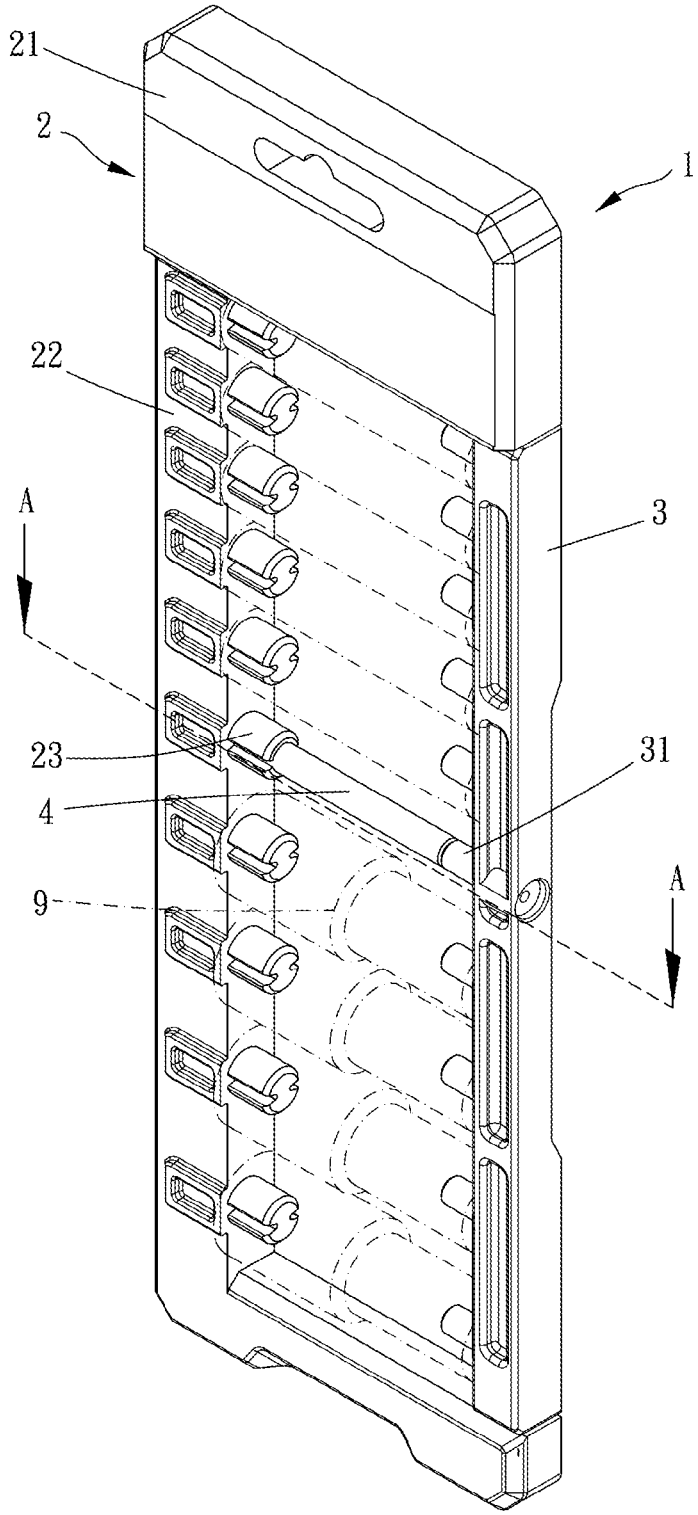
FIGS. 1 and 2 are perspective views of a preferred embodiment of the present invention.
Figure 2:
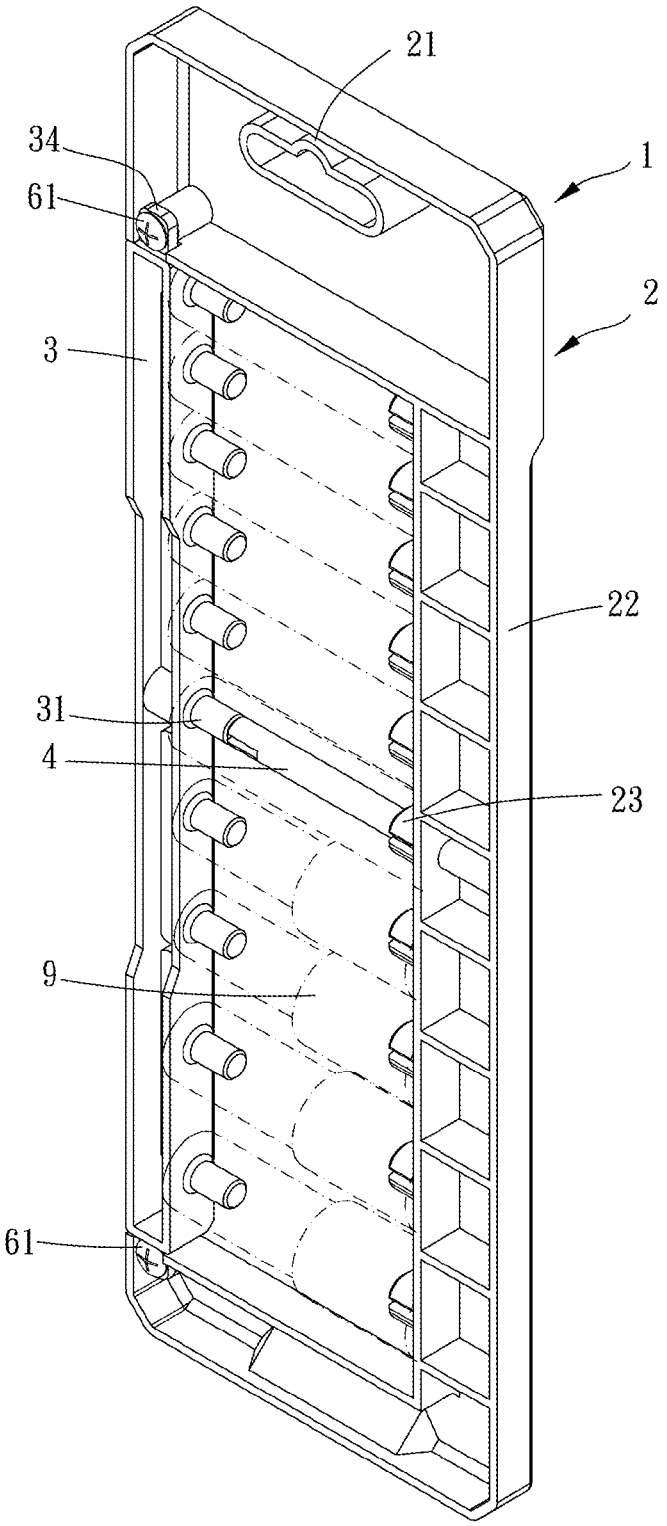
Figure 3:
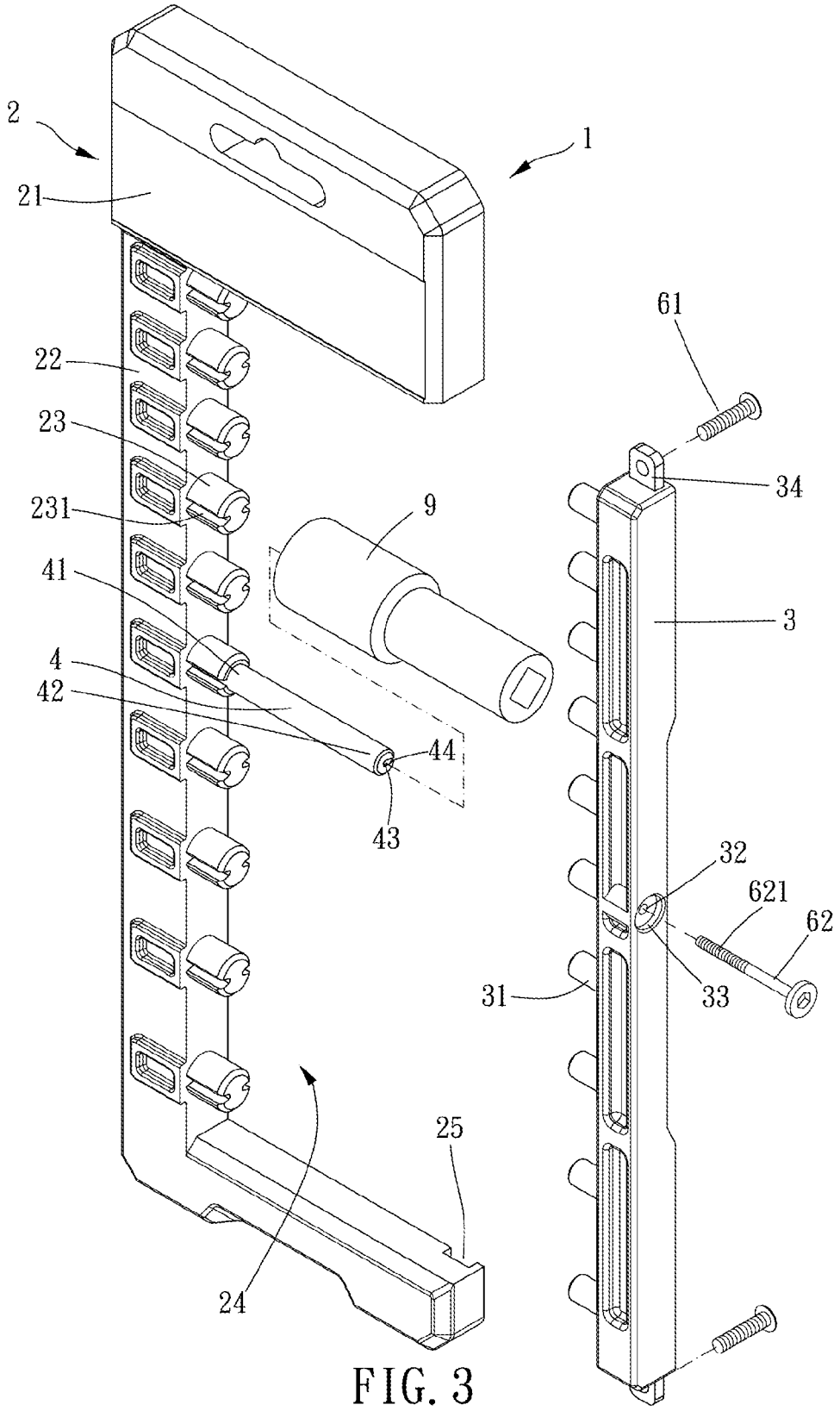
FIG. 3 is a breakdown view of the preferred embodiment of the present invention.
Figure 4:
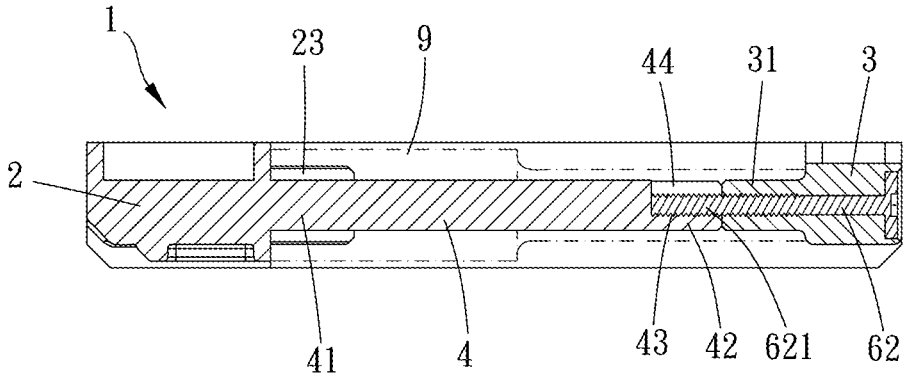
FIG. 4 is a cross-sectional view of the preferred embodiment of the present invention, taken along line A-A in FIG. 1.

Please refer to FIGS. 1 to 4 for a preferred embodiment of the present invention. A tool holder 1 is provided for at least one socket 9 to be assembled thereto, and in this embodiment, there are a plurality of the sockets 9. The tool holder 1 includes a main body 2, a positioning member 3 and at least one rod 4.

The main body 2 includes a hanging portion 21 and an assembling portion 22, and the assembling portion 22 is protrudingly formed with at least one first engaging block 23.

The positioning member 3 is assembled to the main body 2, and the positioning member 3 extends toward the assembling portion 22 to form at least one second engaging block 31 opposite to the at least one first engaging block 23. In this embodiment, there are a plurality of the first engaging blocks 23 and second engaging blocks 31, each said first engaging block 23 and each said second engaging block 31 are for being engaged with two ends of one said socket 9 respectively, two opposite ends of the positioning member 3 are respectively fixed to the main body 2 via a first fixing member 61, so the positioning member 3 can restrict each said socket 9 in the assembling portion 22.

The at least one rod 4 has a first end 41 and a second end 42 opposite to the first end 41, the first end 41 is disposed on one said first engaging block 23, each said rod 4 is for being disposed through one said socket 9, and the second end 42 and one said second engaging block 31 are fixed to each other via a second fixing member 62. The two opposite ends of the positioning member 3 are fixed to the main body 2; therefore, the second end 42 and the second engaging block 31 are unmovable relative to each other, the positioning member 3 cannot be bent or deformed toward a direction opposite to the first engaging blocks 23, and each said second engaging block 31 cannot be disengaged with one said socket 9. Hence, the tool holder 1 is anti-theft. It is to be noted that in this embodiment, a number of the rod 4 is one, but in other embodiments, the number of the rod 4 may change according to lengths of the main body 2 and the positioning member 3 in actual practice.

Specifically, in this embodiment, the main body 2 is substantially square C-shaped and may further include a receiving space 24 for the sockets 9 to be received therein, the at least one first engaging block 23 protrudes into the receiving space 24, and the positioning member 3 bars an opening end of the receiving space 24.

Preferably, the first end 41 of the rod 4 is integrally formed from one said first engaging block 23, so the tool holder 1 is more convenient to be manufactured and has a stronger structure.

In this embodiment, the positioning member 3 is formed with at least one through hole 32, the through hole 32 penetrates through one said second engaging block 31, and the second fixing member 62 is disposed through the through hole 32 to fix the first engaging block 23 and the second engaging block 31 together. Preferably, an end of the through hole 32 remote from the second engaging block 31 may be further formed with a radially-enlarged section 33, and the second fixing member 62 is disposed through and embedded in the radially-enlarged section 33 to prevent the second fixing member 62 from being abraded and damaged. Specifically, the second fixing member 62 is formed with an outer threaded portion 621, and the second end 42 is formed with an inner threaded portion 43 which is screwed with the outer threaded portion 621 of the second fixing member 62 so as to effectively fix the second end 42 and one said second engaging block 31 together. In addition, in this embodiment, a part of the through hole 32 which is located inside the second engaging block 31 is threaded for being screwed with the second fixing member 62 so as to share a pressure of the second fixing member 62 screwed with the second end 42.

More specifically, in this embodiment, a part of the rod 4 near the second end 42 is radially formed with a notch 44, the inner threaded portion 43 is formed on an interior wall of the notch 44, and when viewed in an axial direction of the rod 4, the second end 42 of the rod 4 is substantially C-shaped. When the second fixing member 62 is screwed to the notch 44, the interior wall of the notch 44 slightly deforms to cooperate with a radial dimension of the second fixing member 62; therefore, the notch 44 may be screwed with fixing members which have different radial dimensions. In other embodiments, the interior walls of two ends of the notch 44 may be provided with a closed tightened section to enhance fastening effect of the second fixing member 62.

Specifically, in this embodiment, the rod 4 is columnar, the rod 4 is smaller than one said first engaging block 23 in radial dimension, and each said second engaging block 31 is columnar. The two opposite ends of the positioning member 3 are further respectively formed with an ear plate 34, and each said ear plate 34 is a square board member and is received in a restriction groove 25 of the main body 2. Each said first fixing member 61 is disposed through one said ear plate 34, the two restriction grooves 25 allow the positioning member 3 to be assembled to the main body 2 quickly. Two opposite sides of an exterior circumferential wall of each said first engaging block 23 are respectively axially formed with a slot 231, and each said slot 231 is provided for deformation of the first engaging block 23 so that the first engaging block 23 and the socket 9 can abut against each other tightly. In addition, the rod 4 partially extends into the slot 231 so that the first engaging block 23 has a stronger structure to prevent the first engaging block 23 from being damaged due to deformation.

Given the above, in the present invention, the second end of the rod and one said second engaging block are fixed to each other via a second fixing member, and the two opposite ends of the positioning member are fixed to the main body; therefore, the second end and the second engaging member are unmovable relative to each other, the positioning member cannot be bent or deformed toward a direction opposite to the first engaging blocks, and each said second engaging block cannot be disengaged with one said socket. Hence, the tool holder is anti-theft.

While we have shown and described various embodiments in accordance with the present invention, it should be clear to those skilled in the art that further embodiments may be made without departing from the scope of the present invention.

What is claimed is:

1. A tool holder, provided for at least one socket to be assembled thereto, the tool holder including:

a main body, including a hanging portion and an assembling portion, the assembling portion protrudingly formed with at least one first engaging block;

a positioning member, assembled to the main body, extending toward the assembling portion to form at least one second engaging block opposite to the at least one first engaging block, each said first engaging block and each said second engaging block for being engaged with two ends of one said socket respectively, two opposite ends of the positioning member being respectively fixed to the main body via a first fixing member; and at least one rod, having a first end and a second end opposite to the first end, the first end disposed on one said first engaging block, each said rod for being disposed through one said socket, the second end and one said second engaging block being fixed to each other via a second fixing member;

wherein the second fixing member is formed with an outer threaded portion, and the second end of the rod is formed with an inner threaded portion which is screwed with the outer threaded portion of the second fixing member; and wherein a part of each said rod near the second end is radially formed with a notch, the inner threaded portion is formed on an interior wall of the notch, and when viewed in an axial direction of each said rod, the second end of each said rod is substantially C-shaped.

2. The tool holder of claim 1, wherein the first end of each said rod is integrally formed from the first engaging block.

3. The tool holder of claim 1, wherein the positioning member is formed with at least one through hole, each said through hole penetrates through one said second engaging block, and the second fixing member is disposed through the through hole to fix the first and second engaging blocks together.

4. The tool holder of claim 3, wherein an end of the through hole remote from the second engaging block is formed with a radially-enlarged section, and the second fixing member is disposed through and embedded in the radially-enlarged section.

5. A tool holder, provided for at least one socket to be assembled thereto, the tool holder including:

a main body, including a hanging portion and an assembling portion, the assembling portion protrudingly formed with at least one first engaging block;

a positioning member, assembled to the main body, extending toward the assembling portion to form at least one second engaging block opposite to the at least one first engaging block, each said first engaging block and each said second engaging block for being engaged with two ends of one said socket respectively, two opposite ends of the positioning member being respectively fixed to the main body via a first fixing member; and at least one rod, having a first end and a second end opposite to the first end, the first end disposed on one said first engaging block, each said rod for being disposed through one said socket, the second end and one said second engaging block being fixed to each other via a second fixing member;

wherein the main body is substantially C-shaped and further includes a receiving space for the at least one socket to be received therein, the at least one first engaging block protrudes into the receiving space, and the positioning member bars an opening end of the receiving space; and wherein each said rod is columnar, each said rod is smaller than one said first engaging block in radial dimension, each said second engaging block is columnar, the two opposite ends of the positioning member are further respectively provided with an ear plate, each said ear plate is a square board member and is received in a restriction groove of the main body, each said first fixing member is disposed through one said ear plate, and two opposite sides of an exterior circumferential wall of each said first engaging block are respectively axially formed with a slot.

6. The tool holder of claim 5, wherein the rod partially extends into the slot.

* * * * *